US008192156B2

(12) United States Patent
Cheng

(10) Patent No.: US 8,192,156 B2
(45) Date of Patent: Jun. 5, 2012

(54) PNEUMATIC TURBINE MOTOR AIR CHAMBER

(75) Inventor: Wei-Hua Cheng, Taoyuan County (TW)

(73) Assignee: X'Pole Precision Tools Inc., Chung-Li, Taoyuan County (TW)

( * ) Notice: Subject to any disclaimer, the term of this patent is extended or adjusted under 35 U.S.C. 154(b) by 1120 days.

(21) Appl. No.: 12/047,046

(22) Filed: Mar. 12, 2008

(65) Prior Publication Data

US 2009/0232649 A1 Sep. 17, 2009

(51) Int. Cl.
*F04D 29/44* (2006.01)

(52) U.S. Cl. ..... 415/199.2

(58) Field of Classification Search ..... 415/30, 415/35, 47, 48, 80, 81, 82, 112, 123, 199.2, 415/202, 211.2, 904
See application file for complete search history.

(56) References Cited

U.S. PATENT DOCUMENTS

| | | | | |
|---|---|---|---|---|
| 2,128,157 | A * | 8/1938 | Monnier et al. | 415/34 |
| 3,945,757 | A * | 3/1976 | Cummens | 415/80 |
| 4,776,752 | A * | 10/1988 | Davis | 415/202 |
| 5,261,233 | A * | 11/1993 | Kishi | 415/904 |
| 5,439,346 | A * | 8/1995 | Bowser et al. | 415/82 |
| 7,077,732 | B2 * | 7/2006 | Dodds | 451/295 |
| 7,524,160 | B2 * | 4/2009 | Kolle et al. | 415/199.2 |
| 7,967,552 | B2 * | 6/2011 | Brett et al. | 415/904 |

* cited by examiner

*Primary Examiner* — Edward Look
*Assistant Examiner* — Adam Benson
(74) *Attorney, Agent, or Firm* — Muncy, Geissler, Olds & Lowe, PLLC

(57) ABSTRACT

A pneumatic turbine motor air chamber drives a pneumatic turbine to rotate through compressed air. The pneumatic turbine has a ring extended from inside thereof that has a plurality of barriers and forms a housing space to hold a speed regulator. The pneumatic turbine also has an air intake coupling hole leading to the housing space and at least one air discharge vent communicating with an air passage to discharge the compressed air. The ring is integrally formed with the pneumatic turbine to enhance operation steadiness of the pneumatic turbine.

11 Claims, 5 Drawing Sheets

PNEUMATIC TURBINE MOTOR AIR CHAMBER

FIELD OF THE INVENTION

The present invention relates to a structure of a pneumatic turbine motor air chamber and particularly to a motor to generate rotation through a pneumatic turbine driven by compressed air to be used on a pneumatic tool.

BACKGROUND OF THE INVENTION

A conventional pneumatic tool has a pneumatic turbine motor driven by compressed air to generate rotation. The pneumatic turbine rotates to generate a centrifugal force which incorporates with a flexible O-ring to control the size of an air inlet and an outlet to stabilize rotation speed of the pneumatic turbine motor.

For instance U.S. Pat. No. 7,077,732 discloses a dual chamber turbine rotor which has a turbine including a spacer and a front cap and a rear cap at two ends to form a first chamber and a second chamber. The front cap and rear cap and two sides of the spacer have respectively a corresponding trough to hold a barrier. The first and second chambers hold respectively an O-ring and have an air passage leading to an air outlet located on an outer side of the turbine. When compressed air enters the pneumatic turbine motor, it presses the O-ring against the barrier such that the compressed air passes through the barrier and air passage to be discharged through the air outlet. Thereby the pneumatic turbine rotor is driven and rotates. The dual chamber design can boost air displacement of the compressed air. Thus the torque of the pneumatic turbine rotor is boosted without increasing the size and weight of the total pneumatic turbine rotor.

However, as the barrier is located separately in the turbine, when in use it is deformed or dislocated due to pressing of the O-ring caused by the compressed air, or even broken. As a result, the torque generated by the pneumatic turbine rotor is uneven.

SUMMARY OF THE INVENTION

The primary object of the present invention is to solve the aforesaid disadvantage and provides a torque to generate steady rotation of a pneumatic turbine motor and improve rotation smoothness thereof.

To achieve the foregoing object the invention provides a pneumatic turbine motor air chamber to drive a pneumatic turbine motor to rotate through compressed air. The pneumatic turbine has a ring extended from inside thereof that includes a plurality of barriers and forms a housing space to hold a speed regulator. The pneumatic turbine has an intake coupling hole leading to the housing space and at least one air discharge vent extended to form an air passage communicating with the housing space. The compressed air enters the housing space through the intake coupling hole and channeled by gaps formed between the barriers into the air passage and air discharge vent to be discharged to drive the pneumatic turbine to generate rotation. The ring is integrally formed with the pneumatic turbine. The speed regulator receives the centrifugal force generated by the rotation of the pneumatic turbine to press the ring and prevent it from deforming. Thus the pneumatic turbine is steadier during operation.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
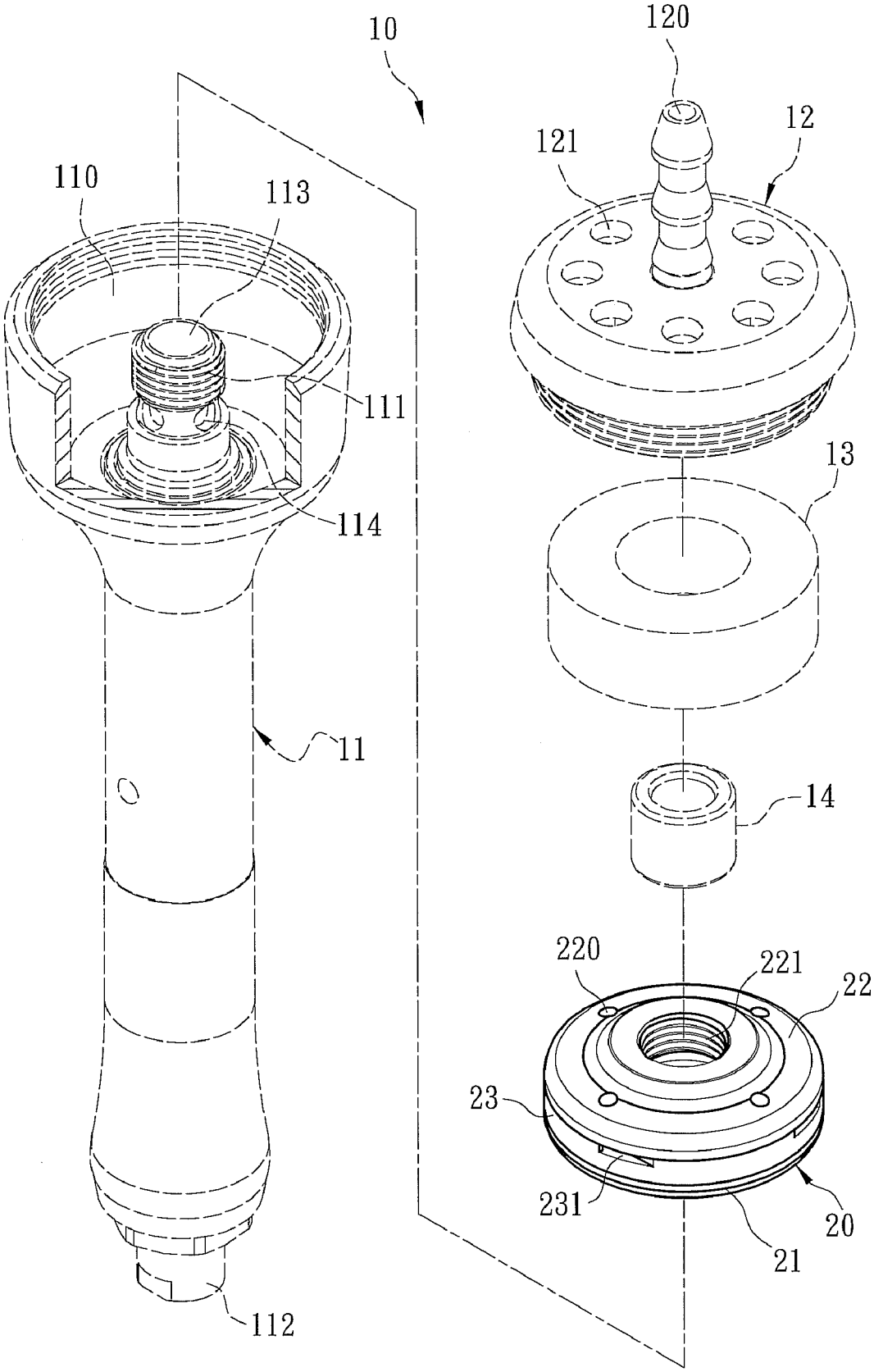
FIG. 1 is a schematic view of an embodiment of the invention.

Please refer to FIG. 1, the pneumatic turbine motor air chamber according to the invention mainly aims to be used on a pneumatic turbine 20 of a pneumatic tool 10. The pneumatic tool 10 has a tool body driven by compressed air to do work on an object. The tool body includes a hand grip 11 and a base 12. The base 12 has an air inlet 120 and a plurality of air outlets 121, and a bottom side coupling with a muffler 13 and an intake sealing sleeve 14. There is a housing compartment 110 formed between the hand grip 11 and the base 12 to hold the pneumatic turbine 20, muffler 13 and intake sealing sleeve 14. The handgrip 11 also holds a spindle 111 extended into the housing compartment 110. The spindle 111 is partially hollow and has an air channeling vent 113 connecting to the intake sealing sleeve 14 and a plurality of openings 114 to form an air intake passage. The pneumatic turbine 20 has an intake coupling hole 221 coupling with the spindle 111 to be rotated therewith at the same time. Moreover the spindle 111 further is coupled with an operation head 112 at one end of the hand grip 11 that is driven and rotated to do work on an object.

Figure 2:
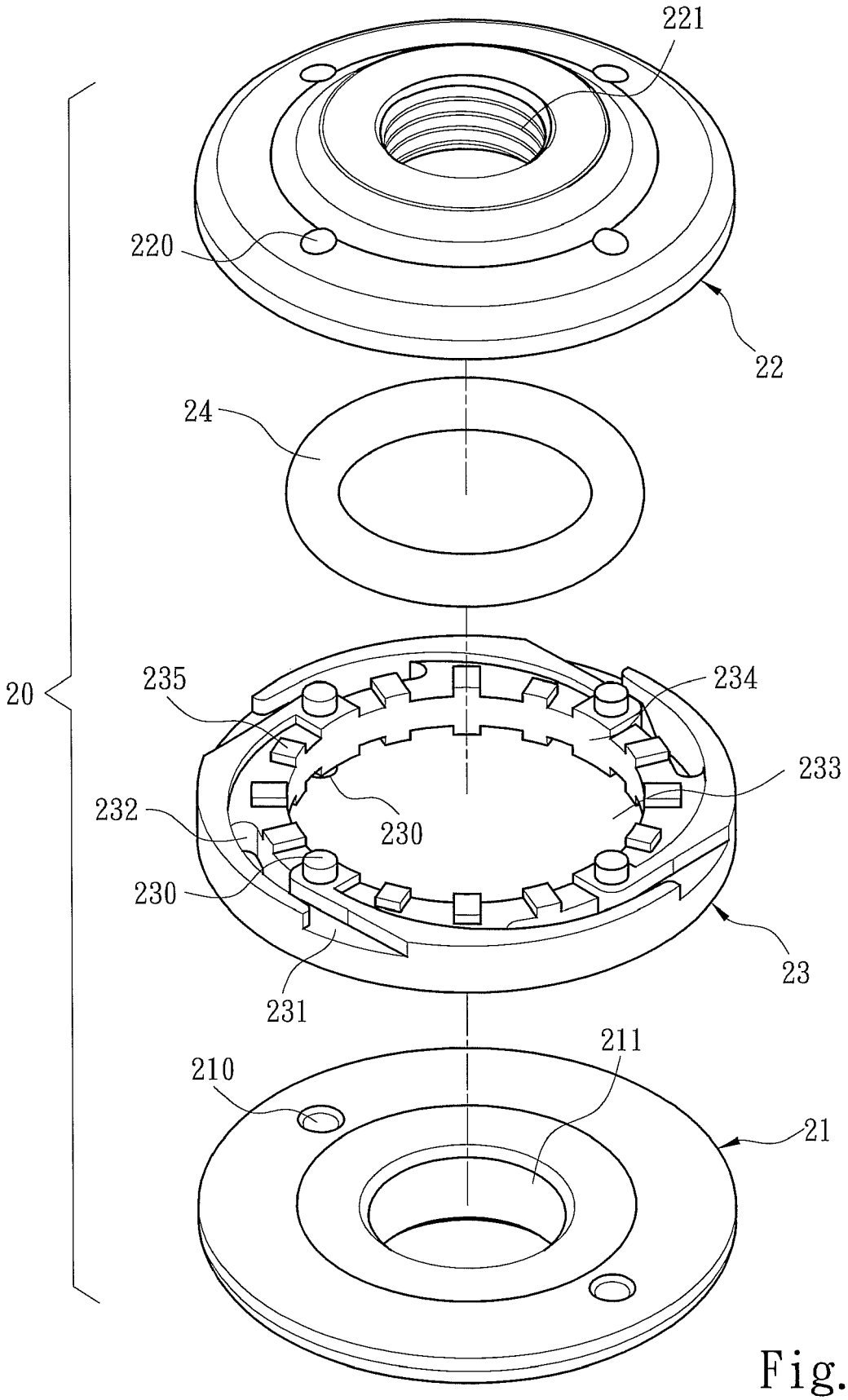
FIG. 2 is an exploded view of the invention.
Figure 3:
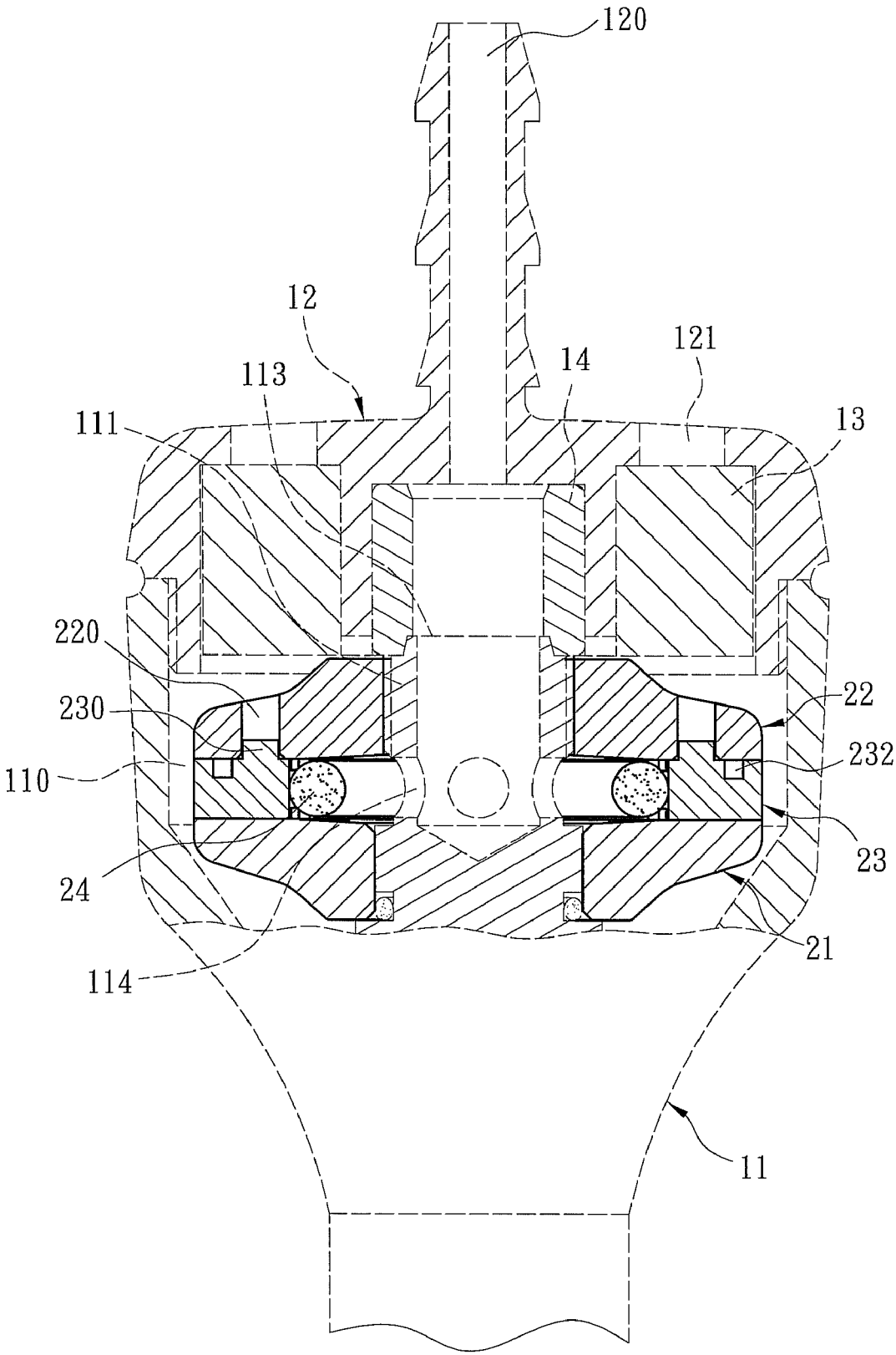
FIG. 3 is a sectional view of the invention.

Refer to FIGS. 2 and 3, the pneumatic turbine 20 mainly includes a front cap 21, a rear cap 22 and a turbine body 23. The turbine body 23 has a plurality of anchor pins 230 at two sides. The front cap 21 and rear cap 22 have respectively a plurality of anchor holes 210 and 220 to form positioning with the anchor pins 230. The numbers of the anchor pins 230 corresponding to the anchor holes 210 and 220 of the front cap 21 and rear cap 22 are different to prevent misfit during assembly. The front cap 21 has an intake anchor orifice 211 run through by the spindle 111. The turbine body 23 has at least one discharge vent 231 communicating with an air passage 232. There is a ring 234 formed integrally in the turbine body 23 through an injection process. The ring 234 is incorporated with the front cap 21 and rear cap 22 to form a housing space 233 to hold a speed regulator 24 (such as an O-ring) and a plurality of barriers 235. When in use, compressed air enters through the air inlet 120 and passes through the intake sealing sleeve 14 to be channeled into the housing space 233 of the turbine body 23, then flows through gaps formed between the barriers 235 into the air passage 232 to be discharged diagonally through the discharge vent 231. Thereby the pneumatic turbine 20 is driven to rotate in the opposite direction of the air discharge (namely clockwise) to drive the spindle 111 to rotate. And the operation head 112 also is driven to rotate. While the pneumatic turbine 20 rotates the flexible speed regulator 24 presses the ring 234 due to the centrifugal force generated by rotating the pneumatic turbine 20 to control the size of the gaps between the barriers 235, thus can stabilize the rotation speed. Finally, the compressed discharged through the discharge vents 231 passes through the muffler 13 and the air outlet 121 at reduced noise. The invention, by providing the integrated ring 234 on the turbine body 23, allows the compressed air entered the pneumatic turbine 20 to be discharged smoothly to stabilize rotation speed during operation of the pneumatic tool 10, thus overcomes the problem of unsteady rotation speed occurred to the conventional pneumatic tool caused by rotation or deformation of the ring 234 separated from the turbine body 23 and pushed by the compressed air.

Figure 4:
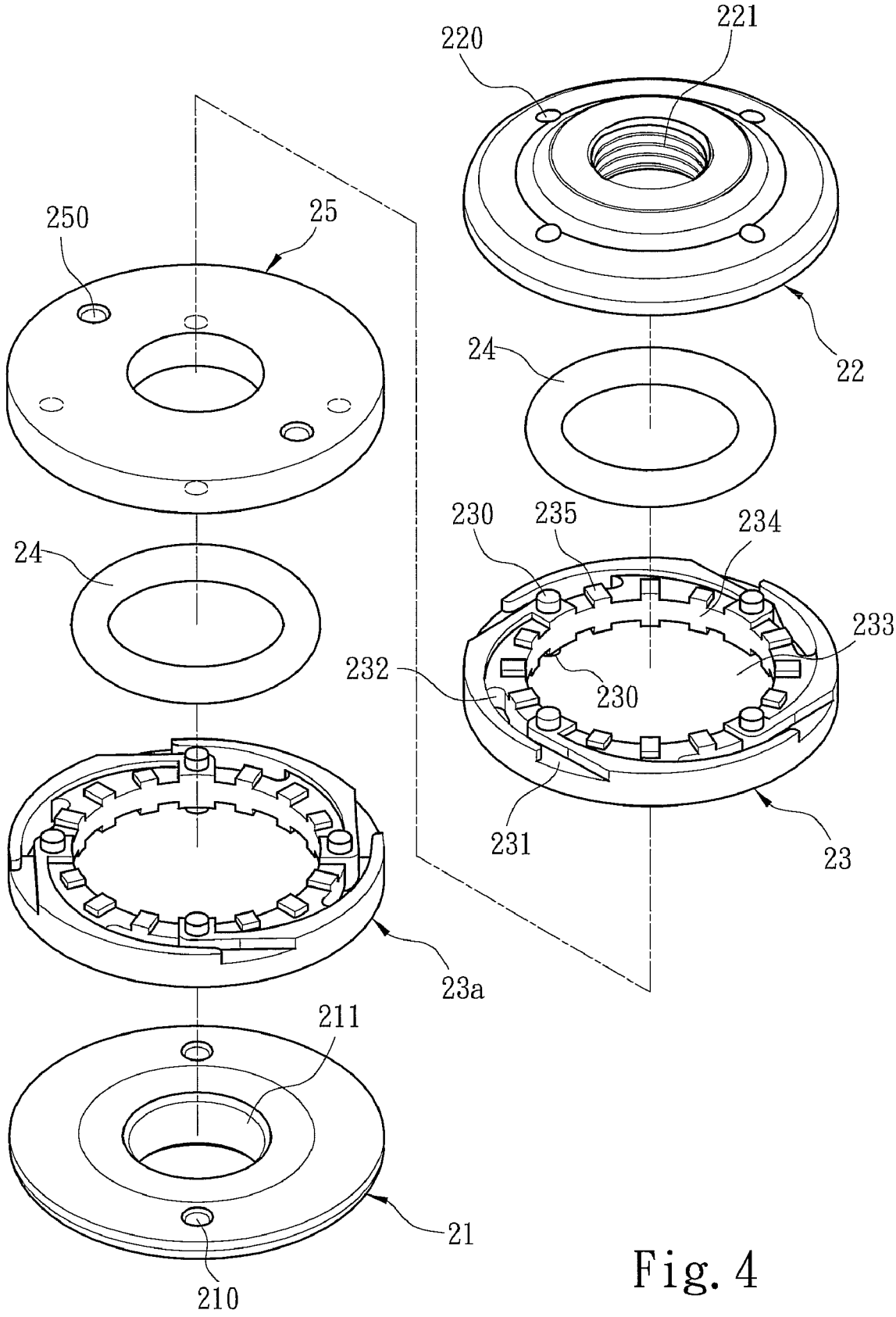
FIG. 4 is a schematic view of another embodiment of the invention.
Figure 5:
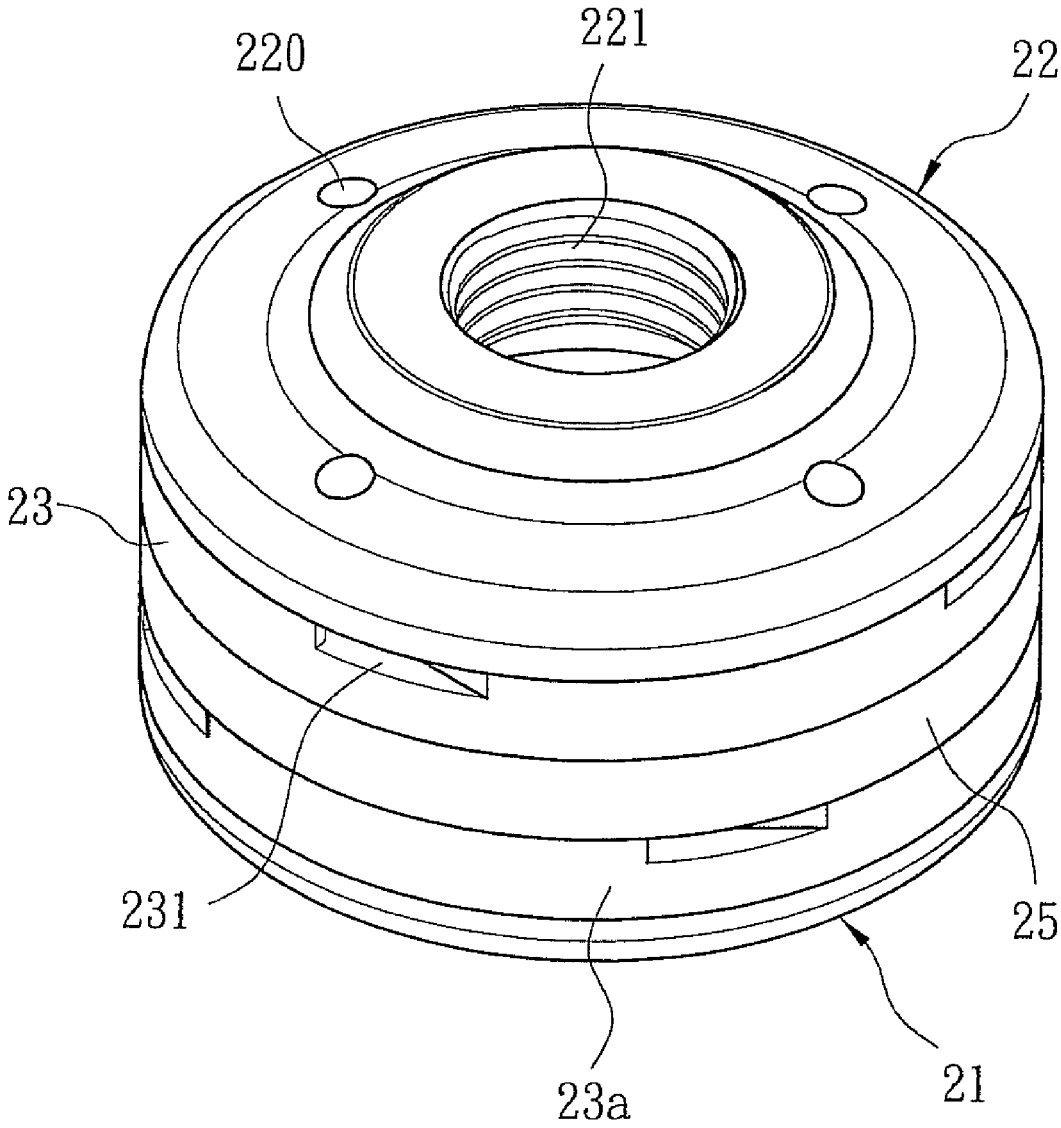
FIG. 5 is a perspective view according to FIG. 4.

In the embodiment set forth above, a plurality of discharge vents 231 may be provided that are spaced from one another at a equal angle such as 90 degrees shown in the drawings to improve rotation steadiness of the pneumatic turbine 20. Referring to FIGS. 4 and 5, the turbine body 23 may further be coupled with a spacer 25 to allow another turbine body 23*a* to be coupled to form the pneumatic turbine 20 consisting of multiple layers of air chambers. The spacer 25 has a plurality of anchor holes 250 on two sides to be coupled with a plurality of anchor pins 230 on the turbine bodies 23 and 23*a*. The discharge vents 231 of the turbine bodies 23 and 23*a* are formed on the periphery of the pneumatic turbine 20 in an equally spaced manner. The number of the discharge vents 231 may vary according to requirements and the size of the housing compartment 110 to adjust the torque of the pneumatic turbine 20 and operation smoothness.

By means of the construction set forth above, with the ring 234 integrally formed on the pneumatic turbine 20, the speed regulator 24 can press the ring 234 due to the centrifugal force generated by rotation of the pneumatic turbine 20 so that deformation of the ring 234 can be prevented. As a result, the pneumatic turbine 20 can operate steadier.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A pneumatic turbine driven by compressed air to rotate, the compressed air being received through an intake coupling hole and discharged through at least one discharge vent formed respectively on the pneumatic turbine, said pneumatic turbine comprising:

a front cap;

a rear cap;

a turbine body which has a plurality of anchor pins at two sides engaging with a plurality of anchor holes formed on the front cap and the rear cap for the rotatable turbine body, causing the front cap and the rear cap to rotate together; and a ring which is extended from inside of the pneumatic turbine and has a plurality of barriers to form a housing space to house a speed regulator, the discharge vent communicating with an air passage to discharge the compressed air from the housing space.

2. The pneumatic turbine of claim 1, wherein the discharge vent has multiple sets located on the pneumatic turbine and spaced from one another at an equal angle.

3. The pneumatic turbine motor air chamber of claim 1, wherein the turbine body is coupled with a spacer to connect another turbine body to form the pneumatic turbine with an air chamber of multiple layers.

4. The pneumatic turbine motor air chamber of claim 3, wherein the spacer has a plurality of anchor holes at two sides to be coupled with a plurality of anchor pins located on the turbine bodies.

5. A pneumatic tool having a pneumatic turbine motor, comprising:

a combination of a base and a hand grip which has an air inlet and an air outlet to receive and discharge compressed air, and a housing compartment inside to hold a spindle which has an air channeling vent communicating with the air inlet and an opening to convey the compressed air; and a pneumatic turbine which is located in the housing compartment and has an intake coupling hole coupling with the spindle and a ring extended from inside thereof that has a plurality of barriers, the ring having a housing space communicating with the opening and housing a speed regulator, the pneumatic turbine having at least one discharge vent communicating with an air passage to discharge the compressed air, the pneumatic turbine including a front cap, a rear cap and a rotatable turbine body which has a plurality of anchor pins at two sides engaging with a plurality of anchor holes formed on the front cap and the rear cap for the rotatable turbine body, causing the front cap and the rear cap to rotate together.

6. The pneumatic tool of claim 5 wherein the housing compartment is formed between the hand grip and the base.

7. The pneumatic tool of claim 5, wherein the housing compartment holds an intake sealing sleeve connecting to the air channeling vent.

8. The pneumatic tool of claim 5, wherein the housing compartment holds a muffler.

9. The pneumatic tool of claim 5, wherein the discharge vent has multiple sets located on the pneumatic turbine and spaced from one another at a same angle.

10. The pneumatic tool of claim 5, wherein the turbine body is coupled with a spacer to connect another turbine body to form a pneumatic turbine with an air chamber of multiple layers.

11. The pneumatic tool of claim 10, wherein the spacer has a plurality of anchor holes at two sides to be coupled with a plurality of anchor pins located on the turbine bodies.

* * * * *